US008646169B2

(12) United States Patent
Ishida et al.

(10) Patent No.: US 8,646,169 B2
(45) Date of Patent: Feb. 11, 2014

(54) METHOD OF MANUFACTURING LIQUID EJECTION HEAD HAVING PROTECTIVE LAYER CONTAINING A NOBLE METAL

(75) Inventors: Yuzuru Ishida, Yokohama (JP); Takahiro Matsui, Yokohama (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 13/413,040

(22) Filed: Mar. 6, 2012

(65) Prior Publication Data

US 2012/0164337 A1 Jun. 28, 2012

Related U.S. Application Data

(62) Division of application No. 12/485,350, filed on Jun. 16, 2009, now Pat. No. 8,172,371.

(30) Foreign Application Priority Data

Jun. 20, 2008 (JP) ..... 2008-161811

(51) Int. Cl.
*H05B 3/00* (2006.01)

(52) U.S. Cl.
USPC ..... 29/611; 29/610.1; 29/825; 29/851; 29/890.01

(58) Field of Classification Search
USPC ..... 29/611, 610.1, 619, 825, 851, 890.01; 347/56, 62–64
See application file for complete search history.

(56) References Cited

U.S. PATENT DOCUMENTS

| | | | | |
|---|---|---|---|---|
| 5,458,254 | A | 10/1995 | Miyagawa et al. | |
| 6,336,713 | B1 * | 1/2002 | Regan et al. | 347/62 |
| 6,443,563 | B1 | 9/2002 | Saito et al. | |
| 6,578,951 | B2 | 6/2003 | Ozaki et al. | |
| 6,607,264 | B1 | 8/2003 | Cox et al. | |
| 7,172,268 | B2 * | 2/2007 | Oikawa | 347/56 |
| 7,306,327 | B2 | 12/2007 | Sakai et al. | |
| 7,591,071 | B2 | 9/2009 | Ibe et al. | |
| 2005/0078151 | A1 | 4/2005 | Bell et al. | |
| 2005/0221523 | A1 | 10/2005 | Kitani | |
| 2006/0033780 | A1 | 2/2006 | Ono et al. | |
| 2006/0033782 | A1 | 2/2006 | Sakai et al. | |
| 2007/0211117 | A1 | 9/2007 | Kitani | |
| 2008/0151007 | A1 | 6/2008 | Kozuka et al. | |
| 2009/0315954 | A1 | 12/2009 | Sakurai et al. | |

FOREIGN PATENT DOCUMENTS

| | | | |
|---|---|---|---|
| JP | 2007-230127 | A | 9/2007 |
| JP | 2007-269011 | A | 10/2007 |
| WO | 87/03364 | A1 | 6/1987 |

* cited by examiner

*Primary Examiner* — Thiem Phan
(74) *Attorney, Agent, or Firm* — Fitzpatrick, Cella, Harper & Scinto

(57) ABSTRACT

A simplified and less costly manufacture process of a print head can be effective in preventing the peeling-off between a substrate and a flow passage forming member. In the print head, a protective layer is formed between the flow passage forming member and a heat generating portion. The protective layer contains a noble metal. On a side of the flow passage forming member, the surface of the protective layer is made of an oxide of a noble metal, except in a portion corresponding to the heat generating portion, while in the portion corresponding to the heat generating portion on the flow passage forming member side, the surface thereof is made of the noble metal.

6 Claims, 8 Drawing Sheets

METHOD OF MANUFACTURING LIQUID EJECTION HEAD HAVING PROTECTIVE LAYER CONTAINING A NOBLE METAL

This is a division of U.S. patent application Ser. No. 12/485,350, filed Jun. 16, 2009.

BACKGROUND OF THE INVENTION

1. Field of the Invention

The present invention relates to a liquid ejection head for printing by ejecting liquid, and a method of manufacturing the liquid ejection head, and specifically relates to an ink jet print head for printing by ejecting ink to a printing medium, and a method of manufacturing the ink jet print head.

2. Description of the Related Art

Usually, a liquid ejection head (hereinafter, also referred to as a print head) used in an inkjet printing apparatus includes an ejection port, a flow passage communicating with this ejection port, and a heat generating portion that generates, in this flow passage, heat energy used to eject ink. The heat generating portion comprises a heating resistor and an electrode for supplying electric power to the heating resistor. Usually, in the print head, in order to prevent electricity from conducting from the heat generating portion to ink, the heat generating portion is covered with a protective layer having an electrical insulation property. For example, a silicon nitride or the like is used as this protective layer. Because the heat generating portion is covered with a protective layer having an electrical insulation property and arranged in this manner, the electrical insulation of the heat generating portion from ink is secured.

Moreover, in the heat generating portion at the time of ejecting ink, a bubbling portion affecting bubbling is exposed to a high temperature due to the heating of the heating resistor in the heat generating portion. Then, at the time of ejecting ink, the heat generating portion will suffer, for example, a chemical action of the ink in combination with an impact due to cavitation phenomenon associated with the bubbling in the ink and the contraction of a bubble. For this reason, in the bubbling portion in the heat generating portion, a protective layer having an anti-cavitation property and an ink resistant property may be provided in a portion close to an ink reservoir so as to cover the bubbling portion. When ink is ejected by the print head, the surface of the protective layer adjacent to the ink reservoir is said to rise up to near 700° C. with the bubbling of the ink. Accordingly, in addition to the properties, such as good mechanical properties, chemical stability, and alkali resistance, this protective layer also requires heat resistance. From these required properties, noble metals, high-melting point transition metals, or alloys thereof have been proposed as the material used in the protective layer adjacent to the ink reservoir. Moreover, nitrides, oxides, silicides, and carbides of noble metals or high-melting point transition metals, or amorphous silicon, an amorphous alloy, and the like have been also proposed.

Among them, noble metals, such as iridium and platinum have been adopted as the protective layer arranged at a position adjacent to the ink reservoir because these are chemically stable and have a property of hardly reacting with ink. Japanese Patent Laid-Open No. 2007-269011 and Japanese Patent Laid-Open No. 2007-230127 disclose such a print head wherein a noble metal is used as the material of the protective layer arranged at the position adjacent to the ink reservoir.

FIG. 8A shows a cross sectional view of the ink jet print head disclosed in Japanese Patent Laid-Open No. 2007-269011. In the ink jet print head of Japanese Patent Laid-Open No. 2007-269011, a heat generating portion 102 is embedded and arranged at a position that allows heat energy to be transferred to the ink in a substrate 101. Then, a first protective layer 103 having an electrical insulation property is arranged so as to cover the heat generating portion 102. Moreover, a second protective layer 107 formed from a noble metal, the second protective layer 107 covering the first protective layer 103, is arranged at a portion adjacent to an ink flow passage in which ink is stored. Japanese Patent Laid-Open No. 2007-269011 enumerates silicon nitride as the material forming the first protective layer 103 having an electrical insulation property. Moreover, as the material forming the second protective layer 107, iridium as a noble metal is enumerated.

FIG. 8B shows an enlarged cross sectional view of a principal part in the ink jet print head disclosed in Japanese Patent Laid-Open No. 2007-230127. In the ink jet print head of Japanese Patent Laid-Open No. 2007-230127, a heat storage layer 202, a heating resistor layer 208, an electrode layer 216, a protective layer 203, and a supplementary layer 217 are sequentially formed above a substrate 201. Moreover, above the supplementary layer 217, a protective functional layer 218 is formed so as to cover a thermal action portion where the generated heat acts on ink. The heat storage layer 202 is formed from a thermal oxide film, an SiO film, a SiN film, or the like, and once stores the heat generated by the heating resistor layer 208. The heating resistor layer 208 generates heat by being energized, and transfers the heat energy to the ink. The electrode layer 216 is formed from a metallic material and functions as wiring. The protective layer 203 is formed from an SiO film, an SiN film, or the like, and serves as an insulating layer having an electrical insulation property. The supplementary layer 217 is formed from tantalum (Ta) or niobium (Nb), and forms a passive film at the time of electrolytic etching in an electrolytic solution, in order to form the protective functional layer 218 by etching. The protective functional layer 218 is a layer for protecting the heat generating portion from a chemical or physical impact associated with the heat generation of the heating resistor in the heating resistor layer 208. Iridium as a noble metal is enumerated as the material forming the protective functional layer 218.

However, in the case where the protective layer formed from a noble metal is adopted as the protective layer arranged adjacent to the ink reservoir, there is a problem that the adhesion between the protective layer formed from a noble metal and a flow passage forming member is poor.

Usually, the flow passage forming member is joined to a substrate having a heat generating portion arranged therein, whereby an ink flow passage and a liquid chamber are defined in the flow passage forming member. A print head is formed in this manner. Moreover, in cases where a protective layer for protecting the arranged heat generating portion is arranged in the substrate, the substrate and the flow passage forming member are joined together via the protective layer. Accordingly, if the adhesion between the protective layer and the flow passage forming member is poor, then peeling-off might occur between the protective layer and the flow passage forming member. For this reason, in Japanese Patent Laid-Open No. 2007-269011, an adhesion layer is provided between the noble metal and the flow passage forming member so as to improve the adhesion therebetween.

In Japanese Patent Laid-Open No. 2007-269011, as shown in FIG. 8A, the substrate 101 and the flow passage forming member 109 are joined together with the first protective layer 103 and the second protective layer 107 sandwiched therebetween, thereby forming the print head. Here, the second protective layer 107 in the print head of Japanese Patent Laid- Open No. 2007-269011 is formed from iridium as a noble metal, and thus if the second protective layer 107 and the flow passage forming member 109 are joined together as they are, the adhesion between the second protective layer 107 and the flow passage forming member 109 is poor. Accordingly, in Japanese Patent Laid-Open No. 2007-269011, the second protective layer 107 and the flow passage forming member 109 are joined together with an adhesion layer 112 and a resin adhesion layer 113 sandwiched therebetween. Thereby, when the flow passage forming member 109 is joined to the substrate 101, the resin adhesion layer 113 and the flow passage forming member 109 will be joined together. Accordingly, the adhesion between these members is improved and the peeling-off between the substrate 101 and flow passage forming member 109 constituting the print head is prevented.

However, in manufacturing the print head disclosed in Japanese Patent Laid-Open No. 2007-269011, the step of forming the adhesion layer 112 and the resin adhesion layer 113 separately from the step of forming the protective layers 103, 107 is required after the second protective layer 107 is formed above the substrate 101. In order to efficiently transmit the heat generated by the heat generating portion 102 to ink, fewer components between the heat generating portion 102 and the liquid chamber are better. Therefore, a configuration may be contemplated, in which the resin adhesion layer 113 is not arranged between the heat generating portion 102 and the liquid chamber, as with the print head disclosed in Japanese Patent Laid-Open No. 2007-269011. If the resin adhesion layer 113 is not arranged between the heat generating portion 102 and the liquid chamber in this manner, then the step of removing the resin adhesion layer 113 in a region corresponding to the heat generating portion 102 will occur and as a result the number of manufacturing steps might increase further. Accordingly, an increase in the number of steps in manufacturing the print head might increase the time required to manufacture the print head and also increase the manufacturing cost.

Moreover, in the print head disclosed in Japanese Patent Laid-Open No. 2007-230127, as shown in FIG. 8B, above the heating resistor in the heat generating portion, the protective functional layer 218 formed from iridium as a noble metal is arranged so as to cover the bubbling portion. Then, in the print head disclosed in Japanese Patent Laid-Open No. 2007-230127, the protective functional layer 218 is not formed in regions other than the bubbling portion in the heating resistor. In the print head of Japanese Patent Laid-Open No. 2007-230127, the protective functional layer 218 in regions other than the bubbling portion in the heating resistor is removed by etching. Thereby, when the flow passage forming member is joined to the substrate 201, the protective functional layer 218 formed from iridium as a noble metal and the flow passage forming member will not be joined together. Accordingly, the adhesion between the substrate 201 and the flow passage forming member is well secured and the peeling-off therebetween is prevented.

However, in manufacturing the print head of Japanese Patent Laid-Open No. 2007-230127, a step is required, in which the protective functional layer 218 is formed in a predetermined shape so that the protective functional layer 218 may not come in contact with a joint portion between the substrate 201 and the flow passage forming member. In Japanese Patent Laid-Open No. 2007-230127, the protective functional layer 218 is formed in a predetermined shape by removing portions corresponding to regions other than the bubbling portion in the protective functional layer 218 by etching. For this reason, the time required to manufacture the print head might increase by the time of the step of forming the protective functional layer 218 in a predetermined shape, and the manufacturing cost might increase.

SUMMARY OF THE INVENTION

Then, in view of the above-described circumstances, it is an object of the present invention to provide a print head that simplifies the manufacture process of a print head and reduces the manufacturing cost while preventing the peeling-off between a substrate and a flow passage forming member in the print head, and a method of manufacturing the print head.

According to a first aspect of the present invention, there is provided a liquid ejection head with an ejection port for ejecting liquid, which comprises: a substrate including a heat generating portion for generating heat energy that is used to eject liquid from the ejection port, and a layer provided so as to cover the heat generating portion; and a member made of resin and provided so as to come in contact with the layer, the member including a wall of a liquid flow passage communicating with the ejection port; wherein a portion of the layer corresponding to the heat generating portion contains a noble metal as a principal component, and has a value of an atomic percent of the noble metal per unit volume greater than that of a portion of the layer coming in contact with the member.

According to a second aspect of the present invention, there is provided a method of manufacturing a liquid ejection head with an ejection port for ejecting liquid; the method comprises the steps of: providing a substrate, in which a heat generating portion for generating heat energy that is used to eject liquid from the ejection port, and a layer provided so as to cover the heat generating portion, the layer comprising an oxide of a noble metal, are provided; providing a member made of resin on the layer, the member including a wall of a flow passage communicating with the ejection port; and reducing the portion of the layer corresponding to the heat generating portion by heating the heat generating portion.

According to the present invention, the manufacture process of a print head is simplified while preventing the peeling-off between a substrate and flow passage forming member in the print head. It is therefore possible to provide the print head and a method of manufacturing the print head that reduces the time required to manufacture the print head as well as reduces the manufacturing cost of the print head.

Further features of the present invention will become apparent from the following description of exemplary embodiments (with reference to the attached drawings).

DESCRIPTION OF THE EMBODIMENTS

Hereinafter, embodiments for implementing the present invention will be described with reference to the accompanying drawings.

(First Embodiment)

Figure 1:
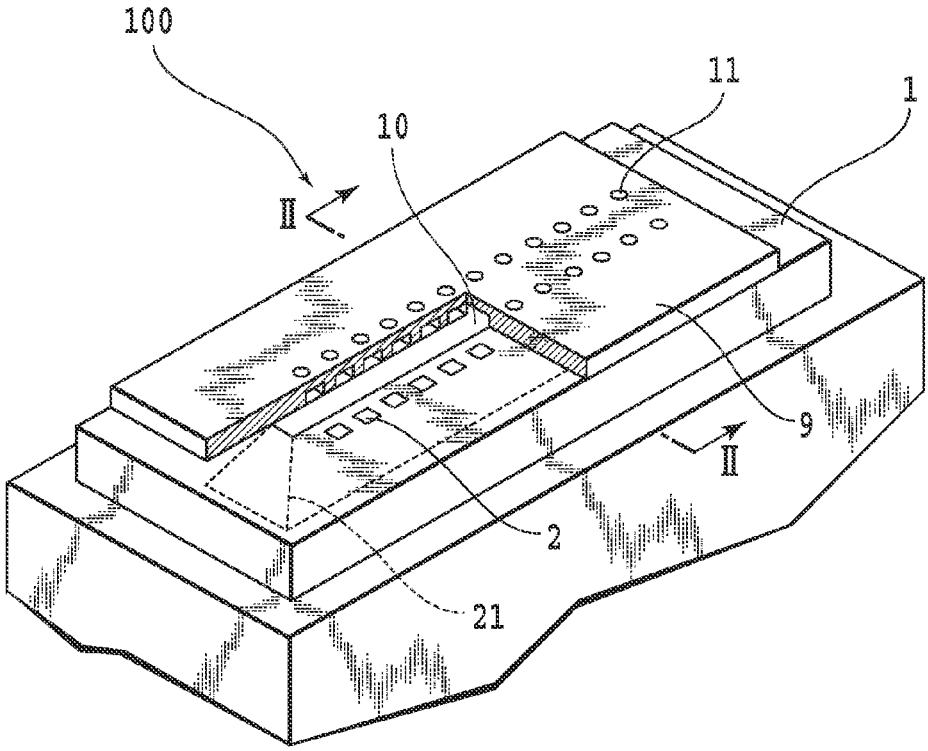
FIG. 1 is a perspective view of a print head according to a first embodiment of the present invention.

FIG. 1 shows a perspective view of a print head 100 according to a first embodiment of the present invention. The print head 100 includes a substrate 1 having a heat generating portion 2 arranged therein, and a flow passage forming member 9 having an ejection port 11 formed therein. Semiconductor elements, such as switching transistors for selectively driving the heat generating portion 2, or the like, are arranged in the substrate 1. Then, the substrate 1 and the flow passage forming member 9 are joined together, whereby a liquid chamber 10 capable of storing ink as a liquid is defined therebetween. Ink is stored in the liquid chamber 10, and heat energy is transferred to this ink by the heat generating portion 2, whereby the ink is ejected from the ejection port 11. Moreover, in the substrate 1, an ink supply port 21 for supplying ink to the print head 100 is formed so as to communicate with the liquid chamber 10. Ink is supplied to the print head 100 from a non-illustrated ink tank through the ink supply port 21.

Figure 2:
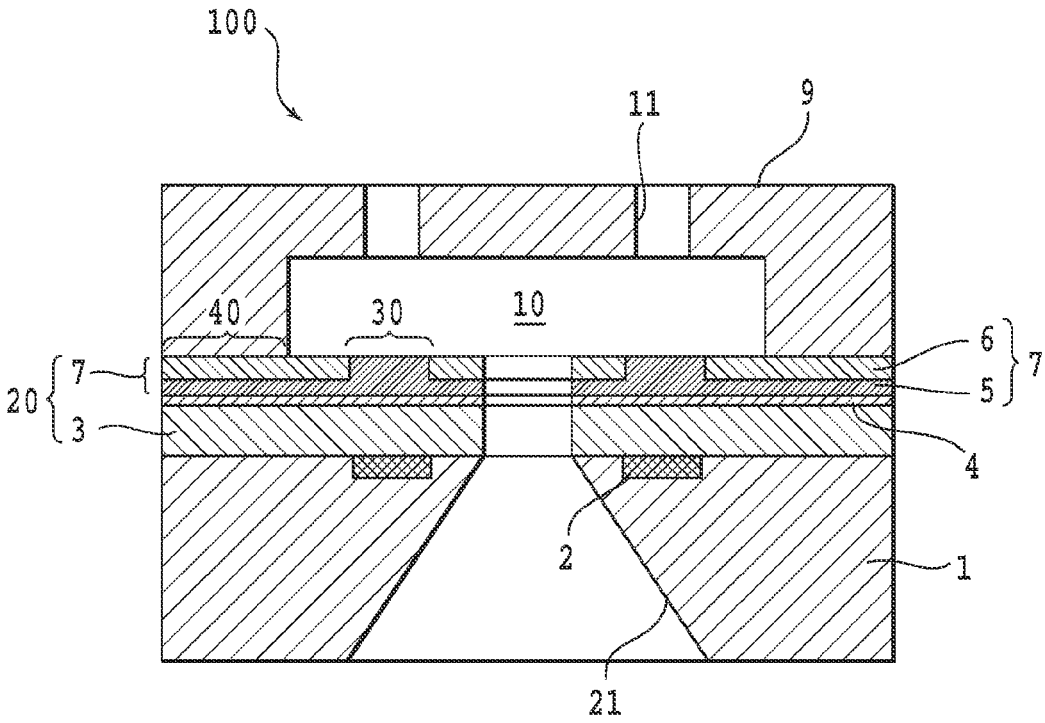
FIG. 2 is a cross sectional view along a II-II line of the print head of FIG. 1.

FIG. 2 shows a cross sectional view along a II-II line of FIG. 1. FIG. 2 is an enlarged cross sectional view showing a principal part of the print head 100 of this embodiment. As shown in FIG. 2, in the print head 100 of this embodiment, the heat generating portion 2 is embedded and arranged in a flow passage forming member side portion in the substrate 1, the portion facing the liquid chamber 10. Here, in the substrate 1, a near side of the liquid chamber 10 and flow passage forming member 9 is referred to as the flow passage forming member side.

In the flow passage forming member side portion of the substrate 1, a protective layer 20 is arranged covering the heat generating portion 2. In this embodiment, the protective layer 20 comprises a first protective layer 3 and a second protective layer 7. The first protective layer 3 is arranged covering the flow passage forming member side portion of the substrate 1, and is formed from a material having an electrical insulation property. In this embodiment, on the flow passage forming member side of the substrate 1, the first protective layer 3 is formed so as to cover the entire surface on the flow passage forming member side in the substrate 1. The first protective layer 3 is formed containing silicon nitride. In this embodiment, the first protective layer 3 is formed from silicon nitride. Moreover, the second protective layer 7 is arranged covering the flow passage forming member side of the first protective layer 3, and is formed containing a noble metal as a principal component. The term "principal component" means that the atomic percent of noble metal per unit volume is no less than approximately 60% and preferably no less than 80%. As the noble metal used for forming the second protective layer, for example, gold, silver, platinum, rhodium, palladium, iridium, ruthenium, osmium, or the like can be used.

Between the first protective layer 3 and the second protective layer 7, the adhesion layer 4 formed containing tantalum (Ta), niobium (Nb), or a compound thereof is arranged. Thus, the adhesion between the first protective layer 3 and the second protective layer 7 can be kept high.

Moreover, in a portion, in the protective layer 20, where the flow passage forming member 9 is joined to the substrate 1, the surface thereof on the flow passage forming member side is made of an oxide of a noble metal. A thermoplastic resin comprising an epoxy resin, a polyether amide resin, a polyimide resin, a polycarbonate resin, a polyester resin, or the like can be used as the material used for the flow passage forming member 9.

In the print head 100 of the first embodiment shown in FIG. 2, iridium is used as the noble metal used for forming the second protective layer. Then, in a portion 40 to be jointed to the flow passage forming member 9 in the second protective layer 7 formed above the substrate 1, the surface thereof on the flow passage forming member side is made of iridium. oxide. Accordingly, the flow passage forming member 9 is joined to the substrate 1 at a portion made of iridium oxide of the second protective layer 7 that is arranged so as to cover the surface on the flow passage forming member side of the substrate 1.

Then, the surface of a portion 30 corresponding to the heat generating portion 2 on the flow pas sage forming member side of the second protective layer 7 is made of a noble metal. The atomic percent of oxygen per unit volume of noble metal of the portion 30 corresponding to the heat generating portion is lower than that of the portion 40 coming in contact with the flow pas sage forming member. In this embodiment, in the portion corresponding to the heat generating portion 2 of the second protective layer 7, the surface thereof on the flow passage forming member side is formed from iridium. Moreover, in the second protective layer 7, the portion 30 corresponding to the heat generating portion is preferably continuous with the portion 40 coming in contact with the flow passage forming member. However, these portions may not be continuous and other member may be provided therebetween.

Moreover, in the print head 100 of this embodiment, in a region within a predetermined distance from the surface of the portion made of iridium oxide on the flow passage forming member side in the second protective layer 7, the closer to the flow passage forming member 9, the higher the oxygen content of iridium oxide becomes. In other words, the above-described content is the atomic percent of oxygen per unit volume of iridium oxide. In contrast, in the region within a predetermined distance from the surface on the flow passage forming member side in the second protective layer 7, the farther from the flow passage forming member 9, the fewer the oxygen content in iridium oxide becomes. Accordingly, the portion made of iridium oxide on the flow pas sage forming member side in the second protective layer is formed so that a portion positioned nearest to the flow passage forming member side may have the highest oxygen content. Accordingly, high adhesion is secured between the second protective layer 7 and the flow passage forming member 9 because the portion of the second protective layer 7, the portion being joined to the flow passage forming member 9, is a portion having a relatively high oxygen content.

According to the print head 100 of this embodiment, the portion corresponding to the heat generating portion 2, of the surface of the flow passage forming member side portion in the protective layer 20, is made of iridium as a noble metal. It is therefore possible to protect the heat generating portion 2 from an impact due to cavitation or chemical action by the ink.

Moreover, according to the print head 100 of this embodiment, the flow passage forming member 9 is joined to the substrate 1 at a portion made of iridium oxide as a metal oxide in the second protective layer 7 that is arranged so as to cover the substrate 1. Accordingly, high adhesion between the substrate 1 and the flow passage forming member 9 can be secured, and the peeling-off between the substrate 1 and the flow passage forming member 9 can be prevented. This ensures high reliability in the print head 100.

Moreover, in this embodiment, since the portion 30 corresponding to the heat generating portion 2 is made of iridium, a hardly-soluble substance "kogation" adhered onto the second protective layer can be removed by electrochemically eluting this iridium. Here, when ink is ejected by the print head, color materials, additives, and the like contained in the ink are heated at high temperature in the bubbling portion in the heat generating portion, whereby these materials may be decomposed on a molecular level and turned into hardly-soluble substances. Then, these substances may be adsorbed onto the heat generating portion. This phenomenon is called "kogation (burnt-deposit)". If the "kogation" occurs and the hardly-soluble organic and inorganic substances are adsorbed onto the heat generating portion, then due to the adsorbed substances, the heat conduction from the heat generating portion to the ink might become uneven and as a result the bubbling might become unstable. However, in this embodiment, the portion corresponding to the heat generating portion 2, of the surface on the flow passage forming member side of the second protective layer 7, is formed from iridium.

Figure 7:
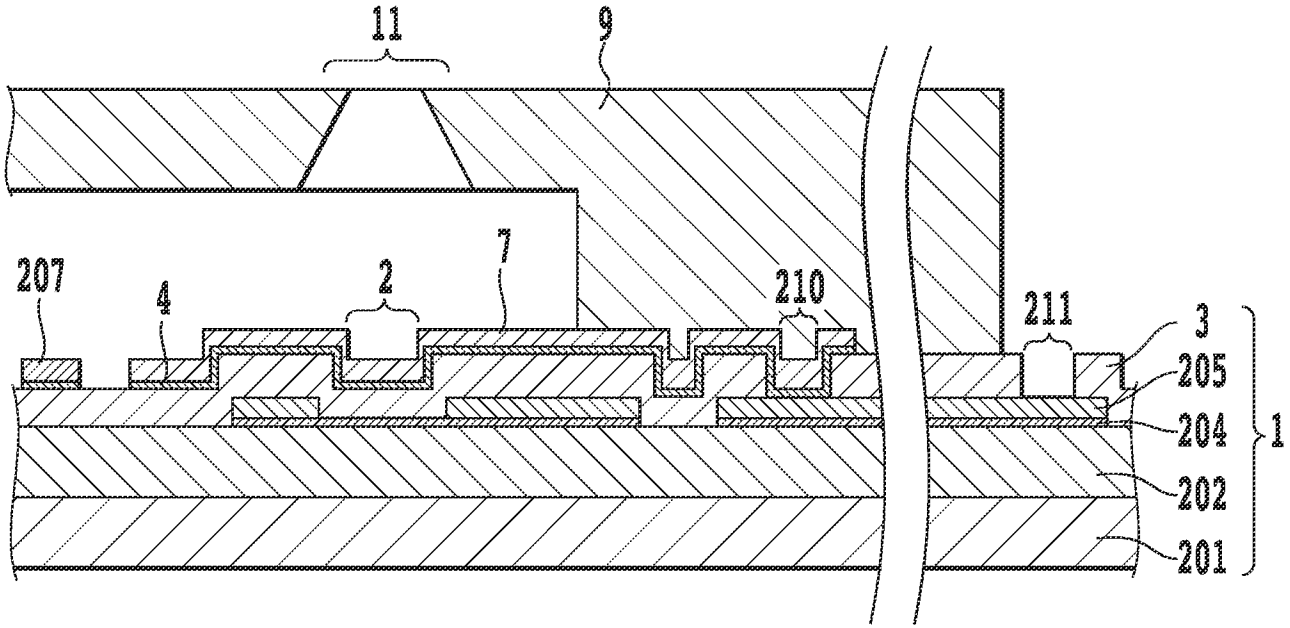
FIG. 7 is another schematic cross section of a liquid ejection head according to an embodiment of the present invention.
Figure 8A:
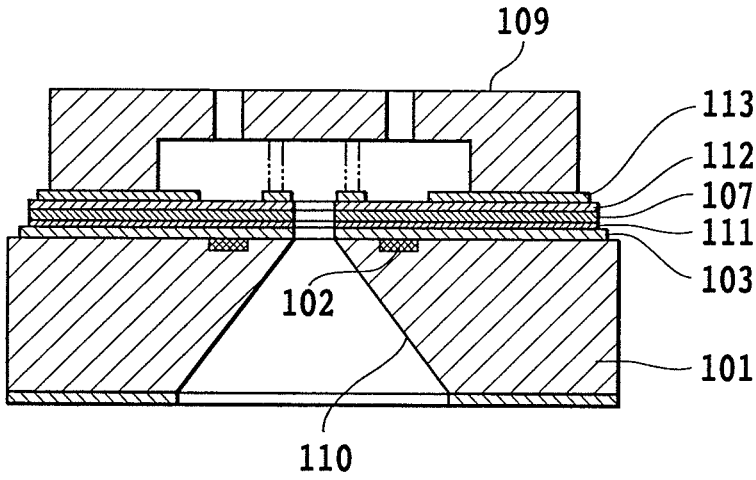
FIG.8A PRIOR ART
FIG. 8A is a cross sectional view showing an example of a conventional print head.
Figure 8B:
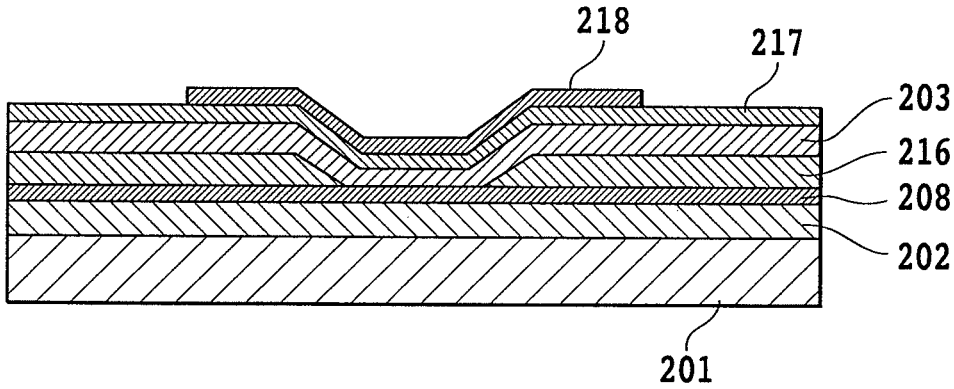
FIG.8B PRIOR ART
FIG. 8B is a cross sectional view showing another example of the conventional print head.

FIG. 7 is another schematic cross section of a liquid ejection head according to an embodiment of the present invention. Using FIG. 7, the electrochemical reaction of kogation removal is described. In the substrate 1, the heat storage layer 202 formed from an SiO film, an SiN film, or the like is provided. An electrode wiring layer 205 comprises a metallic material, such as Al, Al—Si, Al—Cu, or the like. The heat generating portion 2 is formed by removing a part of the electrode wiring layer 205 and exposing a heating resistor layer 204. The electrode wiring layer 205 is connected to a non-illustrated driver element circuit or an external power supply terminal, whereby it can receive electric power from the outside. The first protective layer 3 is provided as the upper layer of the heat generating portion 2 and the electrode wiring layer 205, and is formed from an SiO film, an SiN film, or the like. Above the heat generating portion 2, the second protective layer 7 that protects the heat generating portion 2 from a chemical or physical impact associated with the heat generation and also elutes in order to remove the kogation at the time of cleaning treatment is provided via the adhesion layer 4. In this embodiment, as the second protective layer 4 coming in contact with the ink, the one containing, as a principle component, a noble metal that elutes by an electrochemical reaction in the ink is provided. Specifically, the portion corresponding to the heat generating portion 2 contains iridium as a principal component.

The portion corresponding to the heat generating portion 2, the portion containing iridium as a principal component, of the second protective layer, serves as a thermal action portion that applies the heat generated by the heat generating portion 2 to the ink. The adhesion layer 4 is formed using an electrically conductive material, whereby the second protective layer 7 is electrically connected to the electrode wiring layer 205 via the adhesion layer 4 by means of a through-hole 210. The electrode wiring layer 205 extends to an end portion of the base for the ink jet head, and the tip thereof serves as an external electrode 211 for making an electrical connection to the outside. In order to remove the kogation above the heat generating portion 2, an electrochemical reaction between the ink and the iridium portion of the portion corresponding to the heat generating portion of the second protective layer 7 is used. For this reason, the through-hole 210 is formed in the first protective layer 3, whereby the second protective layer 7 and the electrode wiring layer 205 are electrically connected to each other via the adhesion layer 4. The electrode wiring layer 205 is connected to the external electrode 211, whereby the second protective layer 7 and the external electrode 211 are electrically connected to each other.

Moreover, in the flow passage formed from the flow passage forming member 9, an electrode layer 207 is provided. As the electrode layer 207, a metal that will not be affected even if it comes in contact with an electrolytic liquid such as ink is preferably used. The second protective layer 7 and the electrode layer 207 are not electrically connected to each other when there is no solution in the flow passage. However, if an electrolyte solution containing an ink is present above the substrate, electric current will flow through this solution. As a result, a surface of the iridium portion electrochemically reacts at the interface between the second protective layer 7 and the ink, and is electrolyzed to remove the kogation. When the print head is mounted on a printing apparatus or the like, the above-described voltage can be applied by energizing the print head from the apparatus side. Moreover, the kogation may be removed by mounting the print head on an apparatus dedicated for applying voltages and energizing the print head.

Accordingly, the "kogation" in the print head is removed from the surface on the flow passage forming member side of the second protective layer 7 by eluting the surface of the portion made of iridium and flowing the substances forming the deposited "kogation" together with the eluted iridium. In this manner, the substances forming the "kogation" can be removed from the surface of the portion corresponding to the heat generating portion 2 above the substrate 1.

Figure 3:
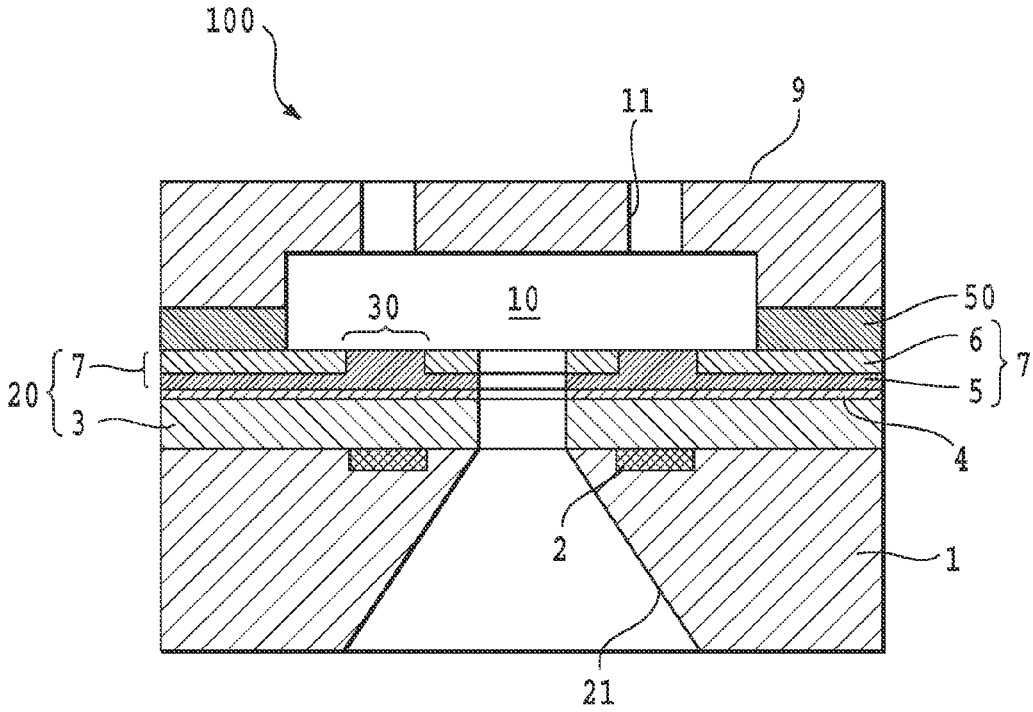
FIG. 3 is a cross sectional view showing an alternative embodiment of the print head of FIG. 1.

Note that, as shown in FIG. 3, an adhesion improving layer 50 of a thermoplastic resin containing polyether amide may be provided in the surface where the flow passage forming member 9 comprising an epoxy resin comes in contact with the iridium oxide portion 6 of the second protective layer 7 in the print head 100. This may further improve the adhesion between the substrate 1 and the flow passage forming member 9. Since the thermoplastic resin containing polyether amide has good adhesion with epoxy resins as well as has high adhesion with a noble metal such as iridium, this thermoplastic resin can prevent the flow passage forming member 9 from peeling off.

Next, a method of manufacturing the print head of the first embodiment is described with reference to FIGS. 4A-4D.

Figure 4A:
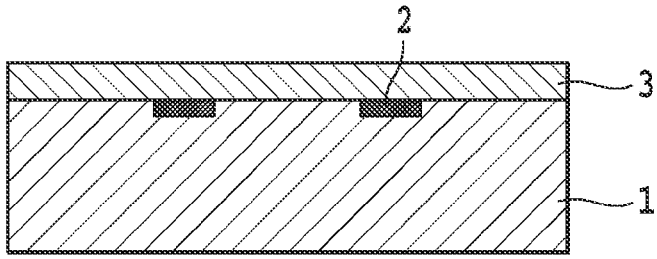
FIGS. 4A-4D are explanatory views for illustrating a manufacturing process of the print head of FIG. 1.

First, in a protective layer formation step, in the flow passage forming member side portion of the substrate 1, the first protective layer 3 formed covering the heat generating portion 2 and the second protective layer 7 made of iridium as a noble metal and formed so as to cover the first protective layer are formed. In the protective layer formation step, first, as shown in FIG. 4A, the first protective layer 3 is formed above the substrate 1 having the heat generating portion 2 arranged therein. Thereby, above the heat generating portion 2 arranged in the substrate 1, the first protective layer 3 is formed. At this time, the first protective layer 3 is formed by plasma-enhanced CVD. The first protective layer 3 is formed from silicon nitride in a thickness from 300 to 1000 nm.

Next, above the first protective layer 3, a layer made of tantalum as the adhesion layer 4 is formed in a thickness from 20 to 200 nm between the first protective layer 3 and the second protective layer 7 by sputtering. Then, above the adhesion layer 4, a portion made of iridium is formed in the second protective layer 7. At this time, this iridium portion in the second protective layer 7 is formed in a thickness from 20 to 80 nm. Then, after the iridium portion 5 in the second protective layer 7 is formed, in an oxide formation step, a layer made of iridium oxide is formed in the surface of the flow passage forming member side portion in the second protective layer 7. In this manner, in this embodiment, the second protective layer 7 is first formed in two layers consisting of the iridium portion 5 on the rear surface side opposite to the flow passage forming member and the iridium oxide portion 6 on the flow passage forming member side.

In this embodiment, the oxide formation step is performed so that the nearer to the flow passage forming member 9, the higher the oxygen content in the iridium oxide forming the second protective layer 7 may become while the farther from the flow passage forming member, the fewer the oxygen content may become. Then, such a distribution of the oxygen content is formed inside the second protective layer 7, in a region within a predetermined distance from the surface on the flow passage forming member side in the second protective layer 7. In this embodiment, the second protective layer 7 is formed from iridium oxide only in the region within a predetermined distance from the surface on the flow passage forming member side in the second protective layer 7. Here, the region within a predetermined distance from the surface on the flow passage forming member side in the second protective layer 7 is a portion made of iridium oxide.

At this time, the step of forming the iridium portion 5 in the second protective layer 7 is performed by sputtering. In this case, a gas such as argon is ionized by applying voltages thereto, thereby impinging the ionized gas such as argon onto iridium. Then, an iridium atom or molecule, which scatters from the surface of an iridium target when the ions comprising argon and the like impinge onto an iridium target, is deposited above the substrate 1, thereby performing film formation of iridium. Thus, film formation of iridium onto the substrate 1 by sputtering is performed.

Figure 4B:
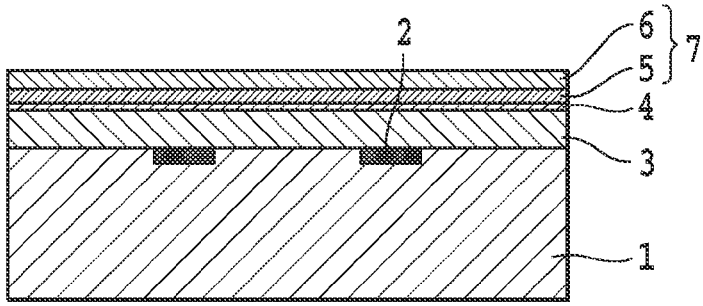

Moreover, the step of forming the iridium oxide as an oxide of a noble metal in the surface of the flow passage forming member side portion of the second protective layer 7 in the oxide formation step is performed by reactive sputtering. By adding an oxygen gas to the gas such as argon in the above-described sputtering step, the iridium scattering from the surface of the target is oxidized in the course of film formation, whereby the film formation of iridium oxide can be performed. In this manner, the iridium oxide layer can be formed by reactive sputtering. The iridium oxide layer at this time is formed so that the thickness thereof may become in a range from 20 to 80 nm. The portion made of iridium in combination with the portion made of iridium oxide serve as the second protective layer 7. In this manner, as shown in FIG. 4B, the first protective layer 3, the adhesion layer 4, and the second protective layer 7 are sequentially formed above the substrate 1. In this embodiment, the adhesion layer 4 is formed from tantalum. Thus, the adhesion between the first protective layer 3 and the second protective layer 7 can be kept high.

Figure 4C:
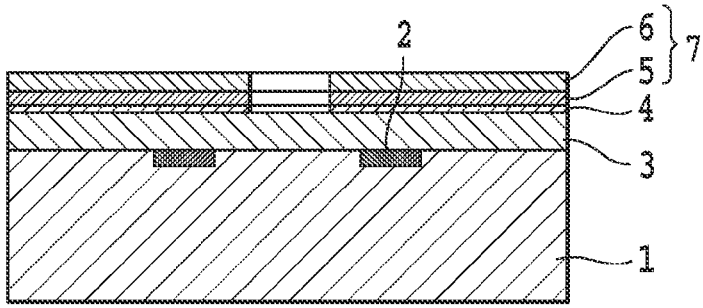

Next, a resist is applied to the iridium oxide portion 6 in the second protective layer, and the resultant resist layer is patterned by performing exposure and development processes. Then, with this patterned resist as a mask, as shown in FIG. 4C, dry etching is sequentially performed to the second protective layer 7 and the adhesion layer 4. Thus, a later-described ink flow passage is formed in the second protective layer 7 and the adhesion layer 4. In this dry etching, etching is performed using as an etchant a mixed gas containing a chlorine-based gas, such as $Cl_2$ or $BCl_3$. Subsequently, the ink supply port 21 is formed in the substrate 1 by etching. Moreover, the flow passage forming member 9, in which a space for defining the ejection port 11 and the liquid chamber 10 is formed, is arranged above the substrate 1. In this manner, the print head 100 is assembled.

Next, in a protective layer reducing step, the portion corresponding to the heat generating portion 2, of the surface on the flow passage forming member side in the oxide formed in the oxide formation step, is heated and reduced by energizing the heat generating portion 2. The iridium oxide formed by sputtering has a property such as when heat energy is applied in vacuum or in a nitrogen atmosphere so that the iridium oxide is heated up to no less than several hundred degrees, the oxygen is reduced and the iridium oxide turns into iridium. Accordingly, by heating the iridium oxide portion 6 of the second protective layer 7 to no less than 500° C. by applying a voltage to the heat generating portion 2 in vacuum or in a nitrogen atmosphere, only the portion corresponding to the heat generating portion 2 can be selectively reduced to iridium.

This step is performed after the first protective layer 3, the adhesion layer 4, and the second protective layer 7 are arranged above the substrate 1, or after the ink supply port 21 is formed thereafter, or after the print head is assembled by joining the flow passage forming member 9 to the substrate 1 thereafter. In the protective layer reducing step, in vacuum, in the atmosphere, in a nitrogen atmosphere, or in a hydrogen atmosphere, the second protective layer 7 in the portion corresponding to the heat generating portion 2 is heated at no lower than 500° C. by applying a pulse voltage to the heat generating portion 2, as when ink is ejected.

Thereby, in the iridium oxide portion 6 of the second protective layer 7, only the portion corresponding to the heat generating portion 2 is selectively heated. Here, the portion corresponding to the heat generating portion 2 is a portion on the flow passage forming member side from the substrate 1, the portion being positioned between the heat generating portion 2 and the liquid chamber 10. In this manner, in the iridium oxide portion 6 of the second protective layer 7, only the portion corresponding to the heat generating portion 2 is heated, whereby the iridium oxide as the oxide of a noble metal of this portion is reduced to form the iridium portion 5.

The composition ratio of iridium oxide in this embodiment is that of iridium dioxide except the small amount of impurities that mix in at the time of film formation by reactive sputtering or the like. Similarly, the composition ratio of iridium after reduction is that of iridium metal except the small amount of impurities that mix in at the time of film formation by reactive sputtering or the like. At this time, if the atomic percent of iridium per unit volume of the portion corresponding to the heat generating portion 2 is compared with that of other portion, the atomic percent of iridium per unit volume of the portion corresponding to the heat generating portion 2 is higher. Furthermore, the atomic percent of iridium per unit volume of the portion serving as iridium oxide is about 33 at %, while the atomic percent of iridium per unit volume of the portion serving as iridium is in a range from approximately 95 to 100 at %.

Figure 4D:
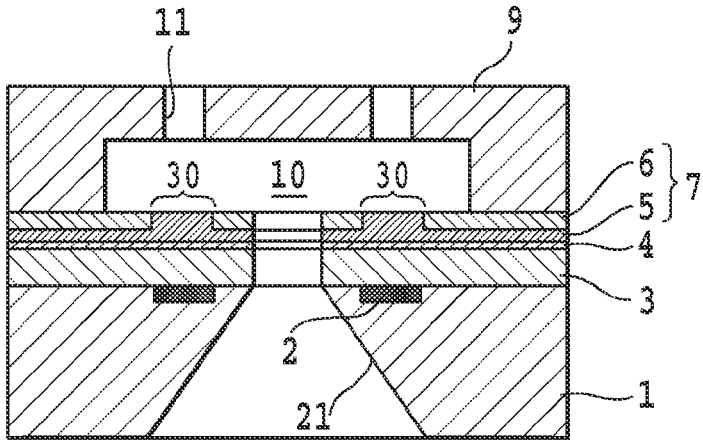

On the other hand, regions other than the portion corresponding to the heat generating portion 2 will not reach the temperature at which the iridium oxide of the iridium oxide portion 6 in the second protective layer 7 is reduced. Accordingly, in the regions other than the portion corresponding to the heat generating portion 2, the iridium oxide will not be reduced but remain as is. Accordingly, as shown in FIG. 4D, the print head 100 is formed wherein in the iridium oxide portion 6 of the second protective layer 7, only the portion 30 corresponding to the heat generating portion 2 is reduced from the iridium oxide to iridium while the other regions will remain as the iridium oxide.

Since the print head 100 is manufactured in this manner, the iridium oxide layer remains formed in the surface on the flow passage forming member side of the joint portion between the substrate 1 and the flow passage forming member 9 in the second protective layer 7. On the other hand, the surface on the flow passage forming member side of the portion corresponding to the heat generating portion 2, of the second protective layer 7, is made of iridium.

In this embodiment, only the portion corresponding to the heat generating portion 2 can be covered with iridium without performing special patterning, so the number of process steps in manufacturing the print head can be reduced accordingly. This makes it possible to provide a method of manufacturing a print head that reduces the time required to manufacture the print head and reduces the manufacturing cost.

(Second Embodiment)

Next, a second embodiment for implementing the present invention is described. The description of portions having the same configurations as those of the first embodiment are omitted and only portions having different configurations will be described.

In the first embodiment, the second protective layer 7 is formed in two layers consisting of the iridium portion 5 on the rear surface side opposite to the flow passage forming member and the iridium oxide portion 6 on the flow passage forming member side. Then, the protective layer reducing step is performed by heating the portion corresponding to the heat generating portion 2 in the state where the second iridium portion 5 and the iridium oxide portion 6 in the second protective layer 7 are overlapped with each other. On the other hand, in the second embodiment, a second protective layer 8, the whole of which is made of iridium oxide, is formed via the adhesion layer 4 on the flow passage forming member side of the first protective layer 3. Then, in this state, the protective layer reducing step is performed by heating the portion corresponding to the heat generating portion 2 in the second protective layer 8, whereby this portion is reduced. In this respect, the second embodiment differs from the first embodiment.

Hereinafter, a method of manufacturing a print head in the second embodiment is described with reference to FIGS. 5A-5D.

Figure 5A:
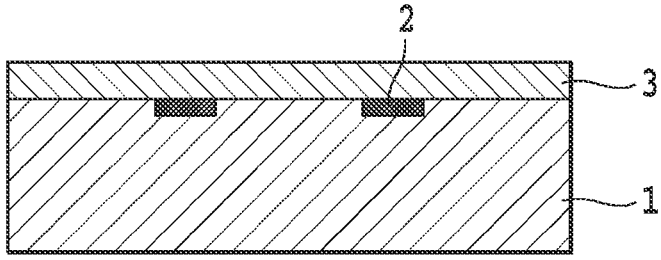
FIGS. 5A-5D are explanatory views for illustrating a manufacturing process of a print head according to a second embodiment of the present invention.
Figure 5B:
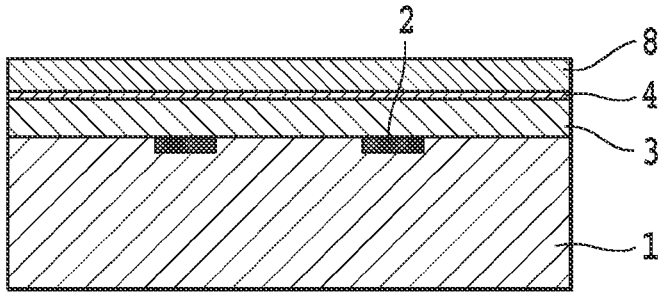
Figure 5C:
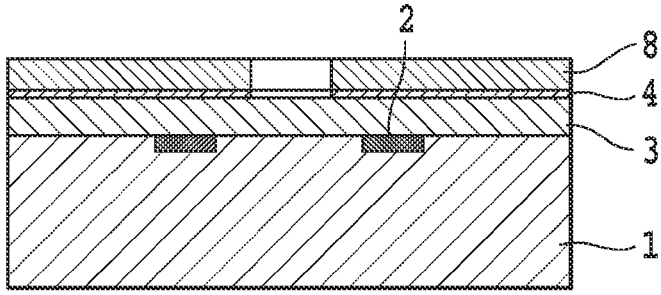

First, as shown in FIG. 5A, on the flow passage forming member side of the heat generating portion 2 arranged in the substrate 1, silicon nitride is formed in a thickness from 300 to 1000 nm as the first protective layer 3 by plasma-enhanced CVD. Next, on the flow passage forming member side above the first protective layer, the adhesion layer 4 is formed from tantalum in a thickness from 20 to 200 nm by sputtering so as to cover the first protective layer 3. Then, as shown in FIG. 5B, on the flow passage forming member side of the adhesion layer 4, the second protective layer 8 made of iridium oxide is formed in a thickness from 40 to 160 nm by reactive sputtering. At this time, the second protective layer 8 formed in this embodiment is formed from iridium oxide over the entire area in the thickness direction from the flow passage forming member side to the rear surface on the opposite side thereof. Next, as shown in FIG. 5C, dry etching is sequentially performed to the second protective layer 8 and the adhesion layer 4.

In the protective layer formation step of forming the protective layer in this embodiment, the protective layer is formed so that in a region within a predetermined distance from the surface on the flow passage forming member side in the protective layer, the nearer to the flow passage forming member 9, the higher the oxygen content in the iridium oxide forming the protective layer becomes. In this embodiment, the region within a predetermined distance from the surface on the flow passage forming member side in the protective layer refers to the entire area in the thickness direction of the second protective layer 8 from the flow passage forming member side of the second protective layer 8 to the rear surface on the opposite side thereof.

Figure 5D:
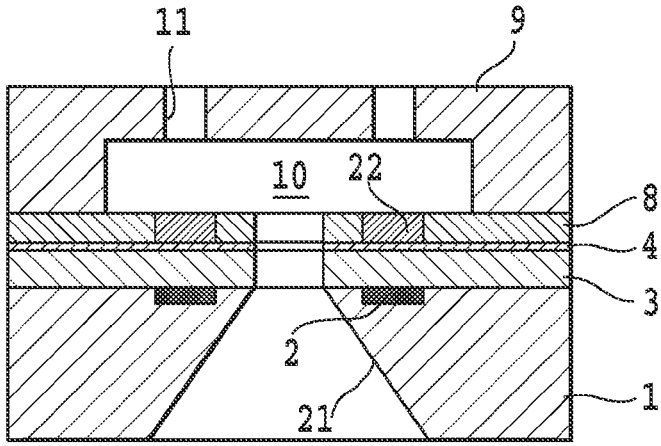

Then, in the protective layer reducing step, by energizing the heat generating portion 2, the portion corresponding to the heat generating portion 2, of the second protective layer 8 formed from iridium oxide, is heated. This heating is performed by applying a pulse voltage to the heat generating portion 2 in vacuum, in the atmosphere, in a nitrogen atmosphere, or in a hydrogen atmosphere, as in the first embodiment. In this manner, the portion corresponding to the heat generating portion 2, of the second protective layer 8, is heated in the protective layer reducing step, whereby the iridium oxide of this portion is reduced to form an iridium portion 22. In this embodiment, the iridium portion 22 is formed so as to penetrate the second protective layer 8 and extend from the surface on the flow passage forming member side in the second protective layer 8 to the rear surface on the opposite side thereof. Then, all the regions other than the iridium portion 22 of the portion corresponding to the heat generating portion 2 in the second protective layer 8 are formed from iridium oxide. Thereby, as shown in FIG. 5D, the joint portion between the substrate 1 and the flow passage forming member 9 in the second protective layer 8 of the print head is formed from iridium oxide. Moreover, the portion corresponding to the heat generating portion 2 in the second protective layer is formed from the reduced iridium. Accordingly, the adhesion between the substrate 1 and the flow passage forming member 9 is kept high. Moreover, the heat generating portion 2 is protected from a chemical action by ink. Moreover, it is possible to prevent the heat generating portion 2 from being damaged by an impact caused by cavitation.

Figure 6:
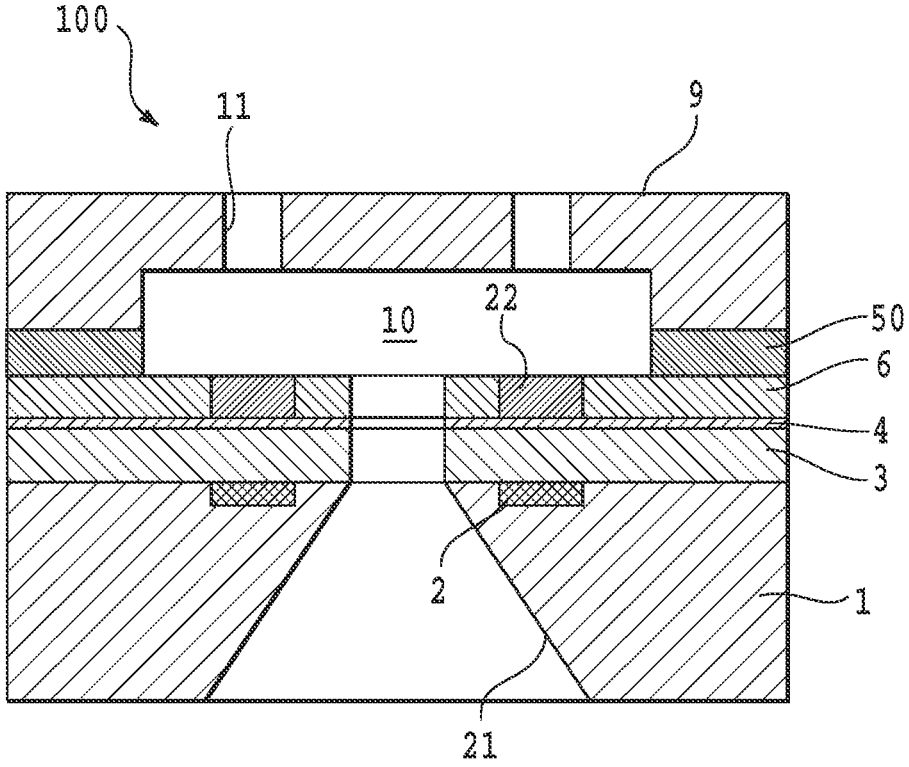
FIG. 6 is a cross sectional view showing an alternative embodiment of the print head of FIG. 5D.

Note that, as shown in FIG. 6, the adhesion improving layer 50 of thermoplastic resin containing polyether amide may be provided in the surface where the flow passage forming member 9 comprising an epoxy resin comes in contact with the second protective layer 8. This may further improve the adhesion between the flow passage forming member 9 and the second protective layer 8. Since the thermoplastic resin containing polyether amide has good adhesion with epoxy resin as well as has high adhesion with a noble metal such as iridium, this thermoplastic resin can prevent the flow passage forming member 9 from peeling off.

According to the method of manufacturing the print head of this embodiment, unlike in the first embodiment, in the step of forming the second protective layer, there is no need to separate the step of forming the iridium oxide portion formed on the flow passage forming member side of the second protective layer and the step of forming the iridium portion formed on the opposite side thereof. Accordingly, the step of forming the second protective layer 8 requires only one step of forming the second protective layer 8 from iridium oxide by reactive sputtering, and it is therefore possible to reduce the number of manufacturing steps further as compared with the first embodiment. This makes it possible to reduce time required to manufacture the print head further and also possible to reduce the manufacturing cost further.

Note that, the print head of the present invention can be mounted on apparatuses, such as a printer, a copying machine, a facsimile machine with a communication system, and a word processor with a printer unit, and furthermore can be mounted on industrial printing apparatuses combined with various kinds of processing units. Then, use of this print head makes it possible to print on various kinds of printing media, such as paper, thread, fiber, textile, leather, metal, plastic, glass, timber, and ceramics. Note that, the term "printing" used in this specification means not only transferring images with meanings, such as texts, graphics, or the like, to a printing medium, but also transferring images without any meaning, such as a pattern or the like, thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-161811, filed Jun. 20, 2008, which is hereby incorporated by reference herein in its entirety.

What is claimed is:

1. A method of manufacturing a liquid ejection head with an ejection port for ejecting liquid, the method comprising the steps of:

providing a substrate, in which are provided a heat generating portion for generating heat energy that is used to eject liquid from the ejection port, and a layer provided so as to cover the heat generating portion, the layer comprising an oxide of a noble metal;

providing a member made of resin on the layer, the member including a wall of a flow passage communicating with the ejection port; and reducing a portion of the layer corresponding to the heat generating portion by heating the heat generating portion.

2. The method of manufacturing a liquid ejection head according to claim 1, wherein said reducing step is performed so that a value of an atomic percent of oxygen per unit volume of a portion of the layer coming in contact with the member is greater than a value of an atomic percent of oxygen per unit volume of the portion of the layer corresponding to the heat generating portion.

3. The method of manufacturing a liquid ejection head according to claim 1, wherein said reducing step is performed so that a value of an atomic percent of noble metal per unit volume of a portion of the layer coming in contact with the member is less than a value of an atomic percent of noble metal per unit volume of the portion of the layer corresponding to the heat generating portion.

4. The method of manufacturing a liquid ejection head according to claim 1, wherein the layer comprising an oxide of a noble metal is formed so that an oxygen content thereof may decrease in a direction approaching a surface of the layer on the substrate side from a surface of the layer on the member side.

5. The method of manufacturing a liquid ejection head according to claim 1, wherein the layer comprising an oxide of a noble metal is formed using a reactive sputtering method.

6. The method of manufacturing a liquid ejection head according to claim 1, wherein the noble metal is iridium, and the portion of the layer corresponding to the heat generating portion that is reduced in said reducing step comprises iridium dioxide.

* * * * *